US011236470B2

(12) United States Patent
Reiser et al.

(10) Patent No.: US 11,236,470 B2
(45) Date of Patent: Feb. 1, 2022

(54) DEVICE FOR SUPPORTING A SWITCH RAIL

(71) Applicant: WIELAND AUSTRIA GES.M.B.H., Amstetten (AT)

(72) Inventors: Georg Reiser, Baden (AT); Rudolf Reiser, Baden (AT); Michael Kainz, Vienna (AT); Robert Kollouch, Leobersdorf (AT)

(73) Assignee: WIELAND AUSTRIA GES.M.B.H., Amstetten (AT)

( * ) Notice: Subject to any disclaimer, the term of this patent is extended or adjusted under 35 U.S.C. 154(b) by 320 days.

(21) Appl. No.: 16/463,244

(22) PCT Filed: Nov. 21, 2017

(86) PCT No.: PCT/AT2017/060306
§ 371 (c)(1),
(2) Date: May 22, 2019

(87) PCT Pub. No.: WO2018/094434
PCT Pub. Date: May 31, 2018

(65) Prior Publication Data

US 2020/0063375 A1 Feb. 27, 2020

(30) Foreign Application Priority Data

Nov. 23, 2016 (AT) ..... A 51060/2016

(51) Int. Cl.
*E01B 7/02* (2006.01)

(52) U.S. Cl.
CPC ..... *E01B 7/02* (2013.01); *E01B 2202/044* (2013.01); *E01B 2202/046* (2013.01)

(58) Field of Classification Search
CPC ..... E01B 7/02; E01B 2202/046; E01B 7/22; E01B 9/38; E01B 9/40; E01B 9/42; E01B 9/44; E01B 9/46; E01B 9/54; E01B 9/58; E01B 9/60; E01B 9/66; E01B 9/685; E01B 9/686; E01B 23/14; E01B 2202/04; E01B 2202/042; E01B 2202/048; E01B 2202/06;
(Continued)

(56) References Cited

U.S. PATENT DOCUMENTS 5,509,626 A * 4/1996 Fodor ..... E01B 7/02 246/453
8,608,115 B2 * 12/2013 Ruetzel ..... E01B 7/02 246/453
(Continued)

FOREIGN PATENT DOCUMENTS

DE 102014218125 B3 * 12/2015 ..... E01B 7/02
EP 1055778 A2 * 11/2000 ..... E01B 7/02
EP 1050623 B1 12/2005
(Continued)

*Primary Examiner* — Zachary L Kuhfuss
*Assistant Examiner* — Cheng Lin
(74) *Attorney, Agent, or Firm* — Dykema Gossett PLLC

(57) ABSTRACT

The invention relates to supporting a switch rail of a switch having a projecting leaf spring which can be pretensioned to the switch rail and on which the switch rail is displaceably arranged. Low friction and easy adaptation to the mounting position is possible in that the leaf spring is adjustably arranged in its longitudinal direction in a guide body which can be fastened to the stock rail.

19 Claims, 7 Drawing Sheets

(58) Field of Classification Search
CPC ..... E01B 2202/08; E01B 2202/044; E01B 7/00–7/30
See application file for complete search history.

(56) References Cited

U.S. PATENT DOCUMENTS

| | | | | |
|---|---|---|---|---|
| 2012/0001030 | A1 | 1/2012 | Ruetzel et al. | |
| 2014/0231533 | A1* | 8/2014 | Lamb | E01B 7/22 238/264 |

FOREIGN PATENT DOCUMENTS

| | | | | |
|---|---|---|---|---|
| EP | 2995718 | B1 | | 6/2017 |
| KR | 101072861 | B1 | * | 10/2011 |
| WO | 0106060 | A1 | | 1/2001 |

* cited by examiner

DEVICE FOR SUPPORTING A SWITCH RAIL

CROSS-REFERENCE TO RELATED APPLICATIONS

This application is a national stage filing based upon International PCT Application No. PCT/AT2017/060306, filed 21 Nov. 2017, which claims the benefit of priority to Austria application No. A 51060/2016, filed 23 Nov. 2016.

BACKGROUND

The invention relates to a device for supporting a switch rail of a switch having a projecting leaf spring which is pretensioned to the switch rail and on which the switch rail is displaceably arranged.

Conventional switches for rail vehicles usually have slidingly mounted rail tongues. When the switch position is adjusted, considerable actuating forces thus occur. Due to necessary lubrication, the surrounding substrate is contaminated and regular application of lubricant is necessary. In the case of switches without switching aids, the sliding surfaces are lubricated by hand to ensure secure operation. This regularly results in an increased logistical effort. In addition, there is always a residual risk if persons are in the track area.

Tongue lifting devices, as described in DE 198 12 795 C1, enable the reduction of wear and thus the saving of large quantities of lubricant by pushing the switch rail upwards by a spring and only resting on the slide chair when a train passes over. However, the still considerable actuating force proves to be disadvantageous, since the friction force is largely independent of the surface.

For these reasons, rolling bearings are increasingly being used. Since the rolling elements cannot withstand the very high loads during the passage of a rail vehicle, special design measures must be taken. One possibility, as described in DE 42 24 158 A1, is to lower the switch rail onto the slide chairs at the end positions by means of recesses in the roller bed. Immediately before reaching the end position, a higher actuating force is required however.

Another solution is described in EP 1 050 623 A2. Here the rolling element is connected via a spring. This enables a continuous rolling bearing arrangement. When loaded by a rail vehicle passing over, the switch rail sits on the slide chair due to the deflection of the spring, via which most of the force can be transmitted.

In practice, however, the time-consuming assembly has turned out to be a problem. The connection with the sleeper or switch base plate requires precise adjustment at at least two points.

Another known solution is described in WO 01/06060 A. A rolling element is arranged on a leaf spring to lift the switch rail during the actuation of the switch. Also in this case the adjustment of the horizontal position is difficult and linked to a change of the spring constant.

The switch rail is mounted at several points on conventional switches. The tongue stroke as well as the distance to the stock rail is different for the different bearings. The tongue stroke is small near the root of the tongue and the distance from the stock rail is large. At the other end of the switch rail the tongue stroke is large, and the distance in the abutting position is zero.

This requires different bearing types for a switch, which necessitates complicated storage. This problem is even more relevant with modern high-speed switches. Here the bending radii are so large that a bearing at several points is necessary.

In practice, therefore, a bearing arrangement that can be easily configured on site for the variable dimensions described above would be advantageous.

SUMMARY OF THE INVENTION

It is the object of the present invention to extend the function of conventional bearings and to offer a much simpler, and thus also quick and inexpensive, device for supporting switch rails.

According to the invention, this object is solved in that the leaf spring is arranged adjustable in its longitudinal direction in a guide body which can be attached to the stock rail. The tongue bearing can thus be simplified substantially. Furthermore, due to the lower rolling friction over the entire stroke, the required actuating force is considerably lower than with conventional bearings of switch tongues or switch rails. This significantly reduces the actuating forces of the switch. Due to the relief of the slide chair, it no longer needs to be lubricated regularly. This saves maintenance effort and costs. The forces to be applied by the drives are thus considerably lower, which protects them. In addition, the actuator could be made much smaller.

The adjustability of the position of the leaf spring bearing in the guide body according to the invention proves to be particularly advantageous, making the device universally applicable and greatly simplifying production and storage. This allows the position of the rolling element to be adapted to the conditions easily and with high accuracy. Irrespective of the position of the slide in the guide body and thus the position of the rolling element relative to the stock rail, the spring length and thus the mechanical and elastic properties remain constant.

The slide can be fixed in the guide body both positively and frictionally, wherein the frictionally engaged variant includes, for example, keyways. This has the advantage of an infinitely variable adjustment possibility.

It may also be provided that the slide is attachable to the guide body via a connection consisting of a surface of greater hardness with a regular or irregular surface structure and a mating surface of lesser hardness. The harder surface can be made of steel, for example, and the counter surface of brass or aluminum, for example. Safety against loosening is achieved by embossing the surface structure of the harder surface into the softer counter surface when tightening the screw.

Within the framework of a positive connection, toothing can be provided both on the slide and in the guide body, whereby the position of the slide is permanently fixed in the direction of adjustment, which is preferably fastened by screwing. This prevents the overhang from being adjusted over the service life of the device, for example by vibration. It is particularly advantageous if the toothing is arranged on one side of the guide body and the matching counterpart on one side of the slide. A secure connection can be achieved if the screw connection is arranged on the same side as the toothing.

In order to allow a particularly large adjustment range, the position of the guide body relative to the stock rail can also be changed. For this purpose, there are several bores on both the clamp body, which forms the connection to the stock rail, and on the guide body, with which the clamp body and guide body can be screwed together in different positions. This allows a coarse adjustment and the fine adjustment can be made by moving the slide into the guide body.

Another possible embodiment variant provides that the clamps are arranged directly on the guide body in order to obtain a simpler system with fewer individual parts.

If the leaf spring is pretensioned to the switch rail, the contact force between the switch rail and the slide chair can be reduced at will when the spring is in contact. When the tongue is rolled up, it can be lifted completely by the slide chair, so that the contact force when gliding over it is completely eliminated.

The pretension can be adjusted via the height of the rolling element relative to the roller block. For precise adjustment, height adjustment of the rolling element in a roller block, which forms the connection between the rolling element and the leaf spring, can therefore be of particular advantage. In particular, the use of screws for adjustment proves to be advantageous.

The best possible line contact between rolling elements and tongue foot edge can be achieved if the roller block with the leaf spring is attached via a locating pin with a degree of freedom of rotation which allows the roller block with rolling elements to pivot slightly about a vertical axis.

By fastening it to the foot of the stock rail, it is possible to mount it independently of different sleepers or slide chair geometries. This can be achieved particularly favorably by means of a clamping connection. A rigid clamp, which is preferably formed integrally by the clamp body, and a screw clamp, which can be screwed to the clamp body, are particularly suitable for this purpose. Universal use can be achieved by using several holders in a row for the screw clamp and a corresponding toothing. During installation, the distance between the clamps can thus be adapted to the existing rail system, in particular the width of the foot of the stock rail.

The use of exactly one rolling element is intended for most positions. However, in the case of large tongue stroke, a second rolling element is required to ensure support over the entire range of motion, i.e. the rolled tongue always rests on at least one roller.

The rectangular cross section of the guide body ensures production at low cost.

BRIEF DESCRIPTION OF THE DRAWINGS

In the following, an embodiment example of the invention is explained in more detail using the figures, wherein.

DETAILED DESCRIPTION

Figure 1A:
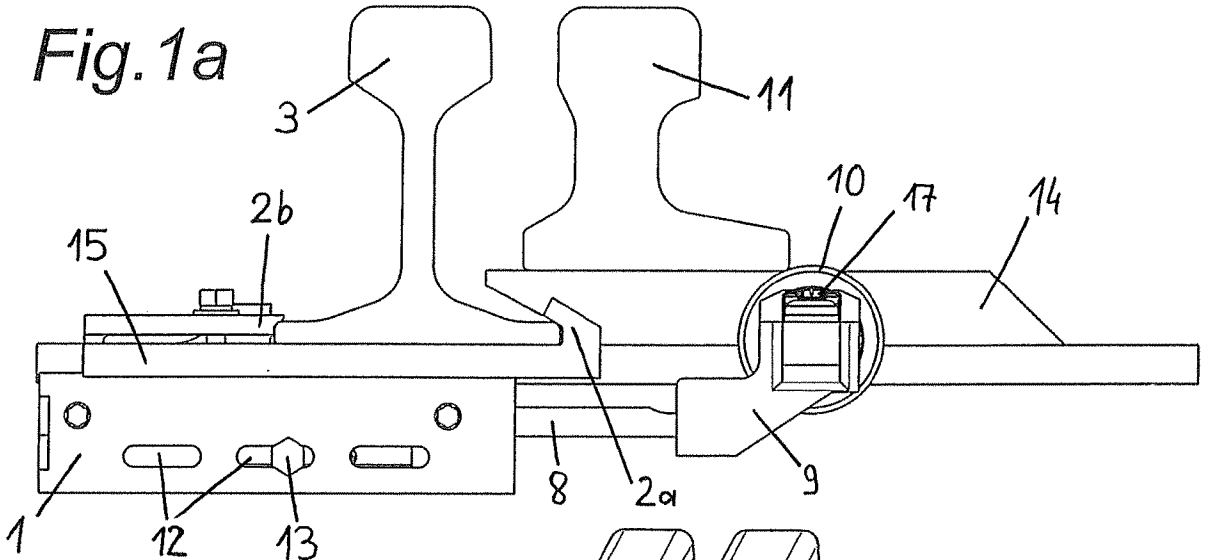
FIG. 1*a* shows a device according to the invention in a side view in a position abutting the stock rail.
Figure 1B:
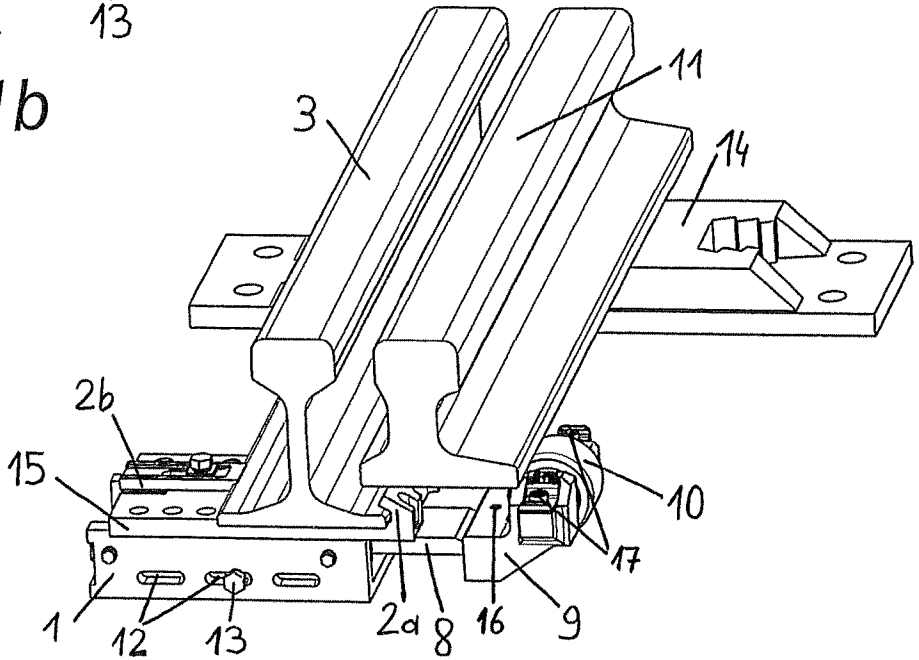
FIG. 1*b* shows the device in an oblique elevated view in a position abutting the stock rail.

A guide body 1 is attached to a stock rail 3 via a clamp body 15 of a device according to the invention by means of clamps 2*a*, 2*b*. The guide body 1 is formed box-like in a U-shape and firmly connected to clamps 2*a*, 2*b* via a clamp body, wherein a rigid clamp 2*a* and a screw clamp 2*b* are provided. The rigid clamp 2*a* is arranged on the clamp body 15 to which a screw clamp 2*b* is screwed. The guide body 1 is screwed to the clamp body 15. Several holes are provided in both the clamp body 15 and the guide body 1 to allow mounting in various positions along a longitudinal axis of the guide body 1.

In the guide body 1 there is a slide 4, which in turn can be moved and fastened longitudinally within the guide body 1. For this purpose, there are elongated holes 12 on one side wall of the guide body 1 to fix the slide 4 with a screw 13. A rack 5 is provided on the inner wall of the guide body 1 to lock the position of the slide 4. Rack pieces 6 engaging in the rack 5 are arranged on the side of the slide 4.

The relative position of the clamp body 15 to the slide 4 can thus be roughly defined by means of the connection between clamp body 15 and guide body 1. Fine adjustment is possible via the connection between guide body 1 and slide 4.

Figure 3A:
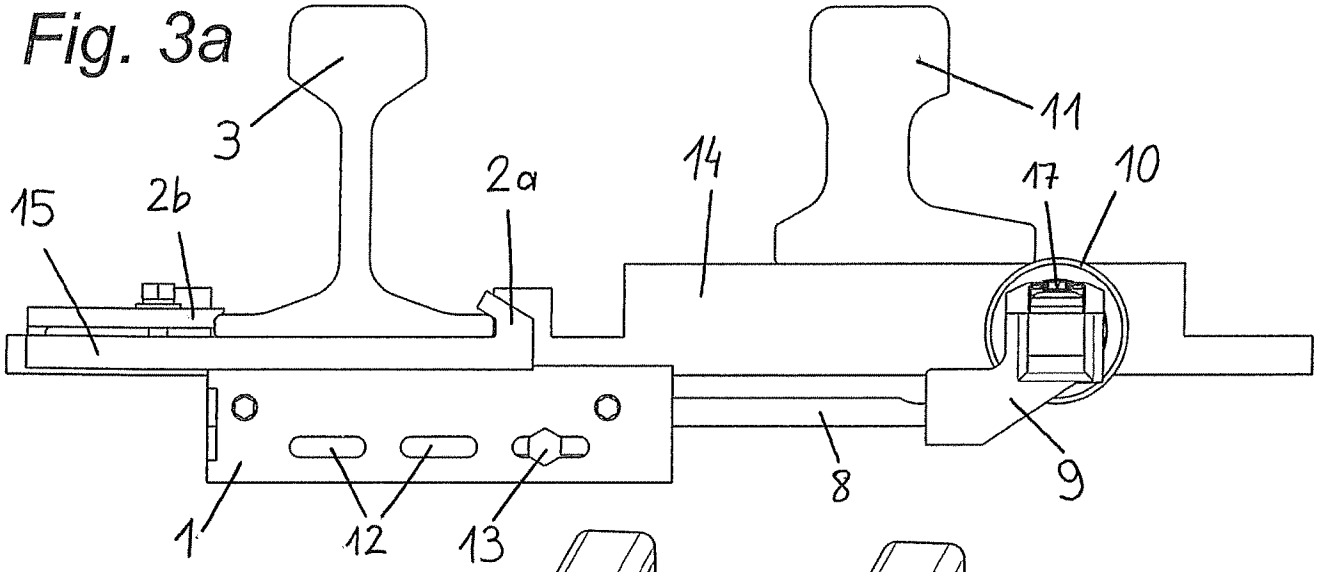
FIG. 3*a* shows a device according to the invention at another point of the switch in a side view in a position abutting the stock rail.
Figure 3B:
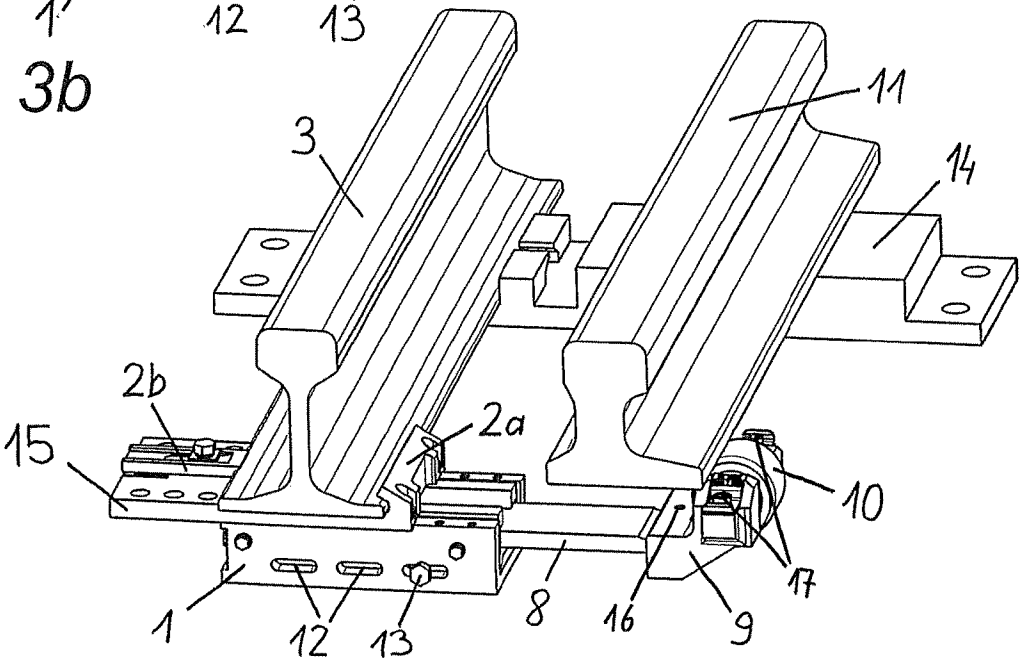
FIG. 3*b* shows the device in an oblique elevated view in a position abutting the stock rail.
Figure 4A:
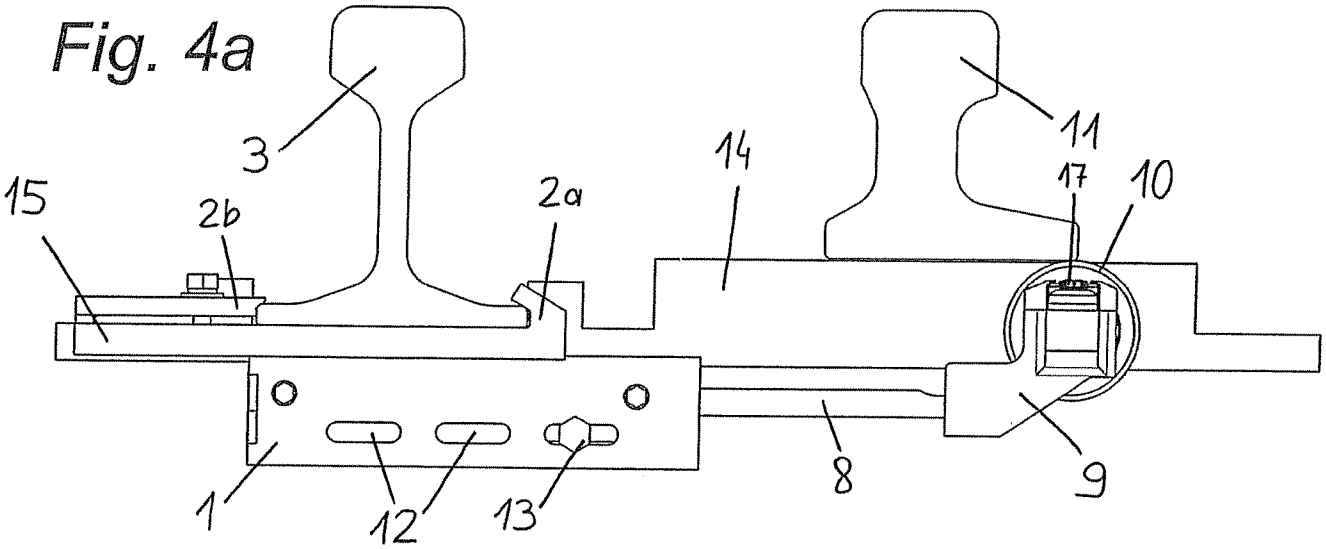
FIG. 4*a* shows the device in a side view in a position remote from the stock rail.
Figure 4B:
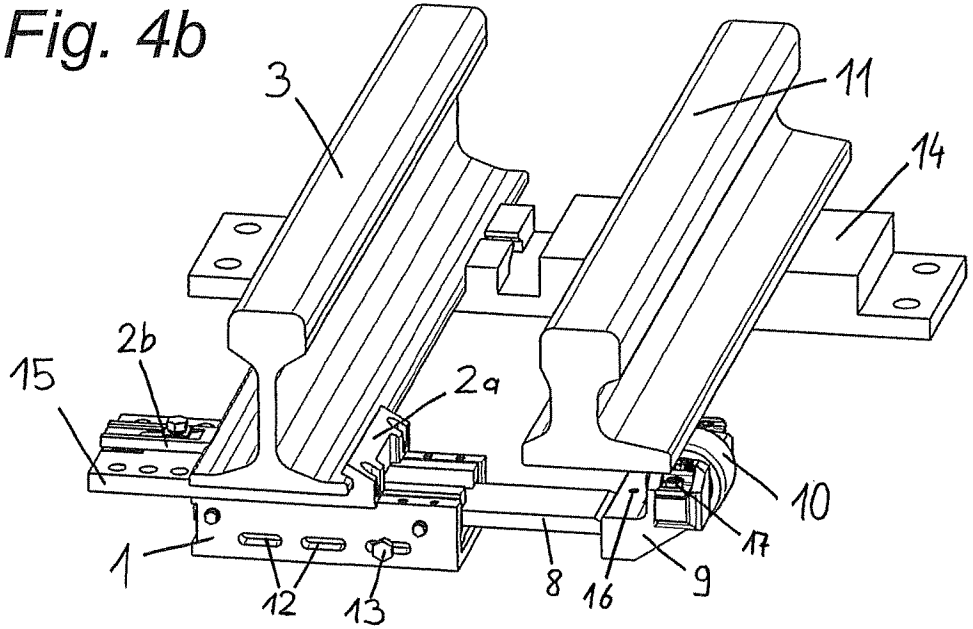
FIG. 4*b* shows the device in an oblique elevated view in a position remote from the stock rail.
Figure 5:
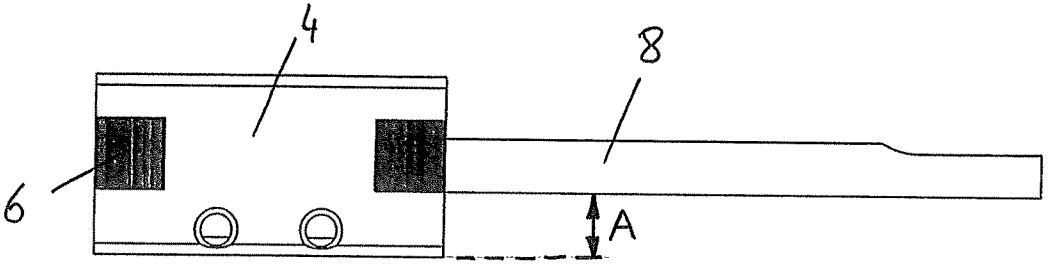
FIG. 5 shows the slide with leaf spring in a side view.
Figure 6:
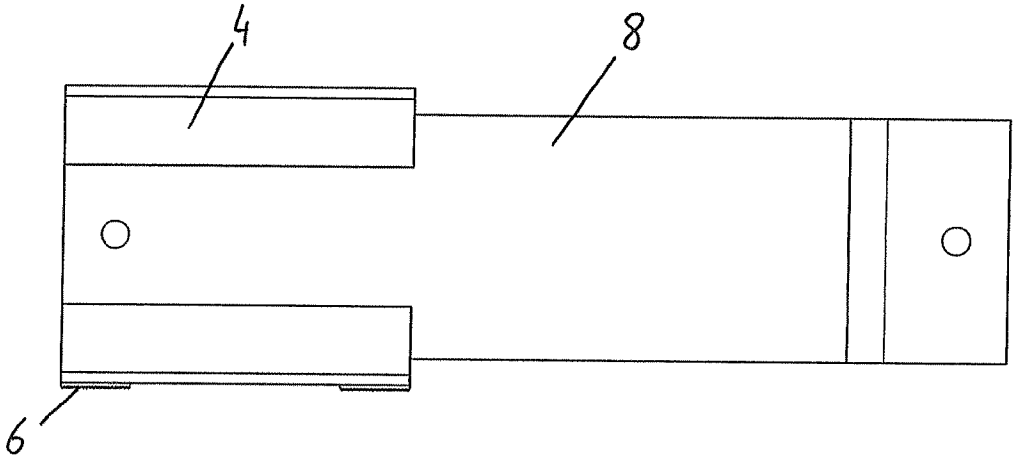
FIG. 6 shows the slide with leaf spring in a plan view.
Figure 7:
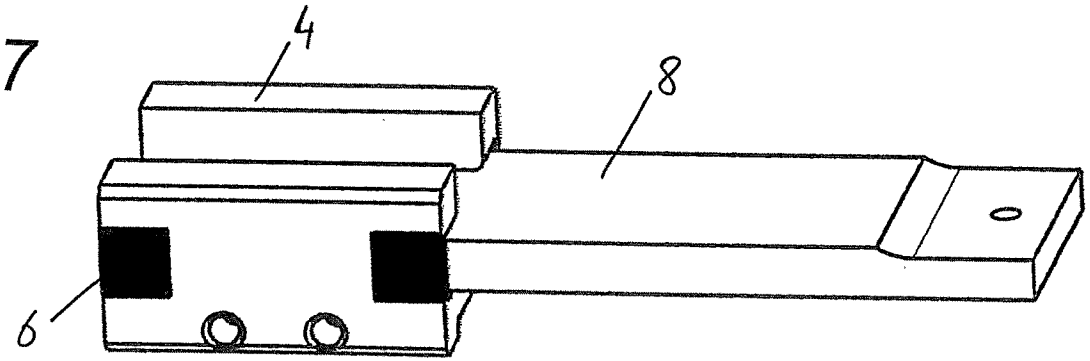
FIG. 7 shows the slide with leaf spring in an oblique elevated view.
Figure 8:
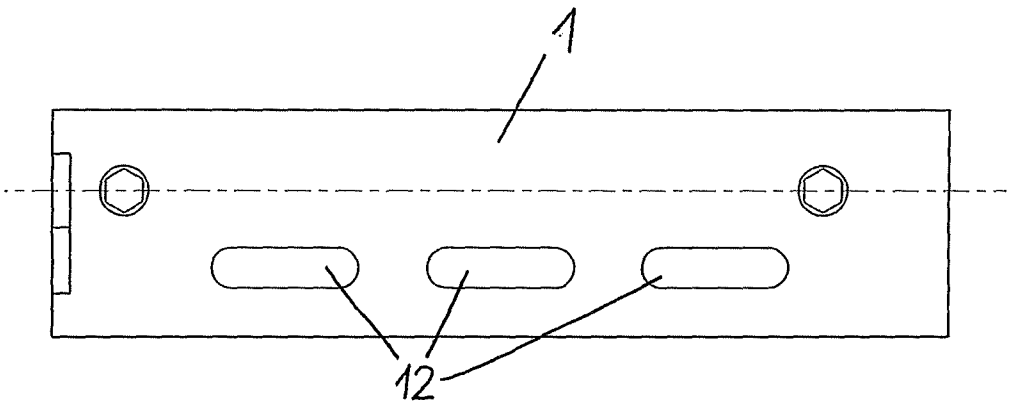
FIG. 8 shows the guide body in a side view.
Figure 9:
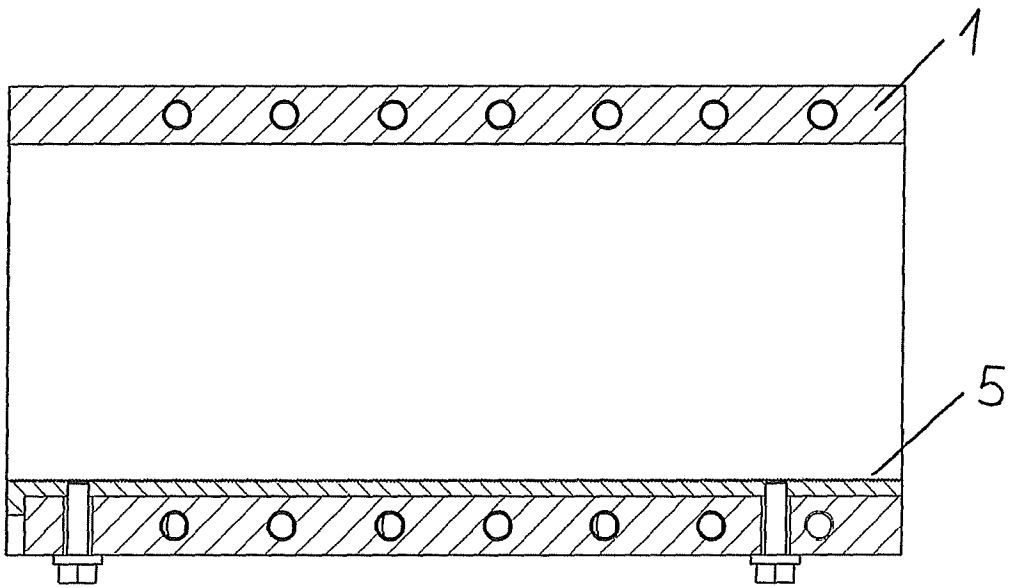
FIG. 9 shows the guide body in a plan view.

Both the distance between stock rail 3 and a switch rail 11, as well as the tongue stroke of the switch rail 11 is different depending on the position of the bearing within the switch. Close to the root of the tongue, the movement range of the switch rail 11 is small and the distance from the stock rail 3 is large. Such a configuration can be seen in FIGS. 3*a* and 3*b*, as well as FIGS. 4*a* and 4*b*. FIGS. 3*a* and 3*b* show the switch rail 11 in a position abutting the stock rail 3. FIGS. 4*a* and 4*b* show the switch rail 11 in a position remote from the stock rail 3.

Over the entire length of the tongue, the distance between the middle plane of the stock rail and the edge of the tongue foot (contact with the roller) varies depending on the type of switch.

Figure 2A:
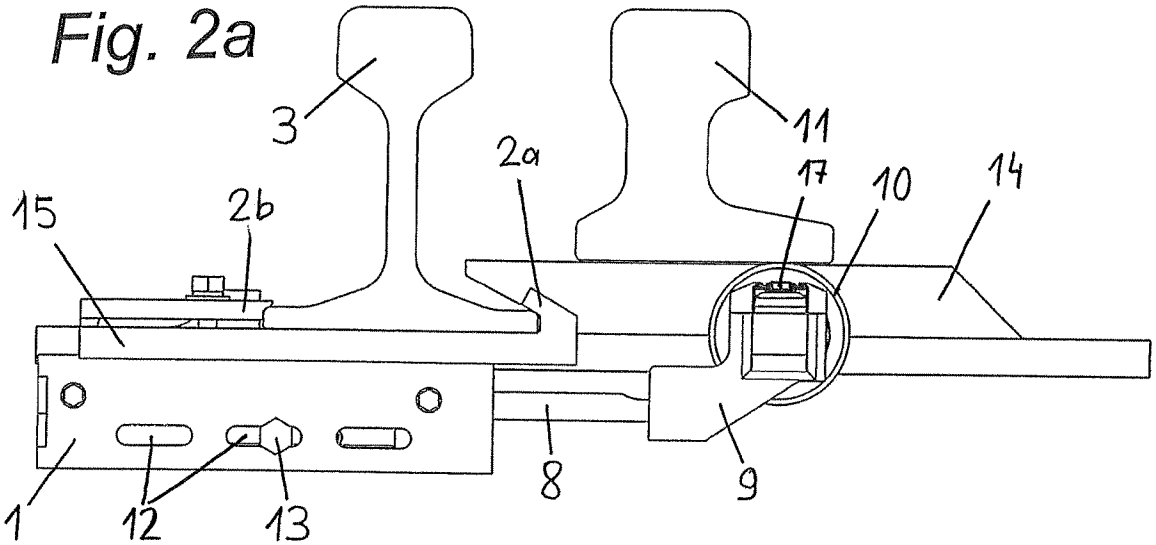
FIG. 2*a* shows the device in a side view in a position remote from the stock rail.
Figure 2B:
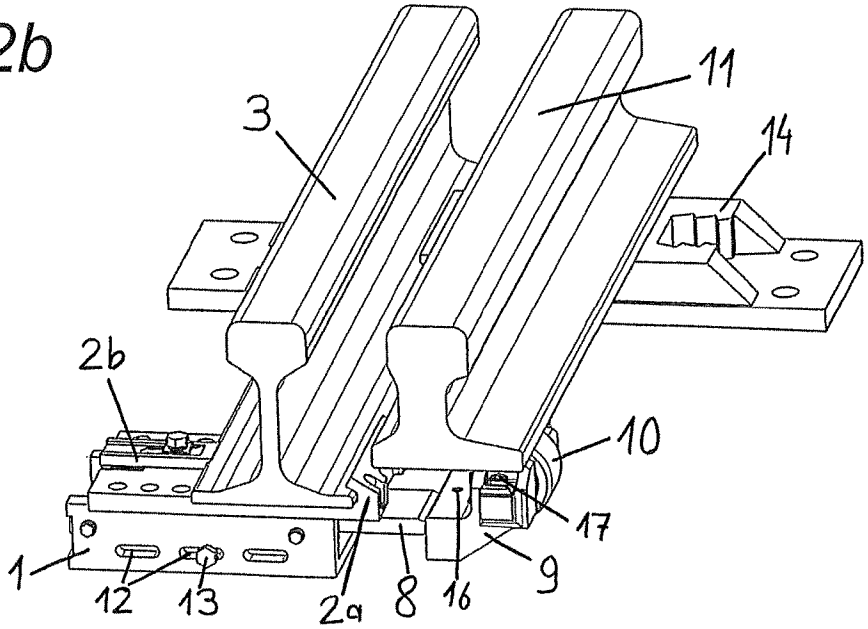
FIG. 2*b* shows the device in an oblique elevated view in a position remote from the stock rail.

In the direction of the tip of the tongue of the switch rail 11, the stroke of the tongue increases. A device according to the invention in an area closer to the tip of the tongue is shown in FIGS. 1*a, b* in the position abutting the stock rail 3 and FIGS. 2*a, b* in the position remote from the stock rail 3.

One end of a leaf spring 8 is attached to slide 4. The surface of the guide body facing away from the stock rail 3 is held at a distance A by the slide 4. This is dimensioned so that the leaf spring 8 does not rest on the guide body 1 even under maximum load. Thus the effective length of the leaf spring 8, and thus the spring characteristics, remains constant.

Another end of the leaf spring 8 is connected to a rolling element 10 via a roller block 9 and set screws 17. The foot of the switch rail 11 rests on this.

The roller block 9 is connected to the leaf spring 8 by a vertical locating pin 16, which allows slight rotation about its axis, so that the rolling elements 10 are aligned at the correct angle to the contact surface of the switch rail 11 even with tolerances of the rolling elements 10.

For optimum adjustment, adjusting screws 17 are also arranged in the roller block 9, with which the rolling element 10 can be adjusted in height. This allows the pretension of the switch rail 11 to be adapted to the requirements.

Due to the pretension of the leaf spring 8, the switch rail 11 is lifted by a slide chair 14 at a very early stage of the movement. This means that when the switch is adjusted, only the lower rolling friction of the rolling elements 10 has to be overcome, but not the sliding friction of the slide chairs.

When a train passes over, the switch rail 11 rests on the slide chair 14, which transmits most of the load force with the exception of the pretension force.

When mounting the system, the approximately required rolling element position is initially set via the clamp body 15—guide body 1 connection. This can be done at the factory in the form of product variants consisting of the same parts, or at the construction site at the beginning of assembly. Next, the entire device is clamped to the stock rail 3 using clamps 2*a*, 2*b*. Now the slide 4 is fine-adjusted in guide body 1, and thus also the position of the rolling element 10 to the stock rail 3. The position of the slide 4 is fixed with the screw 13. The rack 5 and the rack pieces 6 prevent an adjustment, for example by vibration. Finally, the entire system is pretensioned against the switch rail 11.

Figure 10:
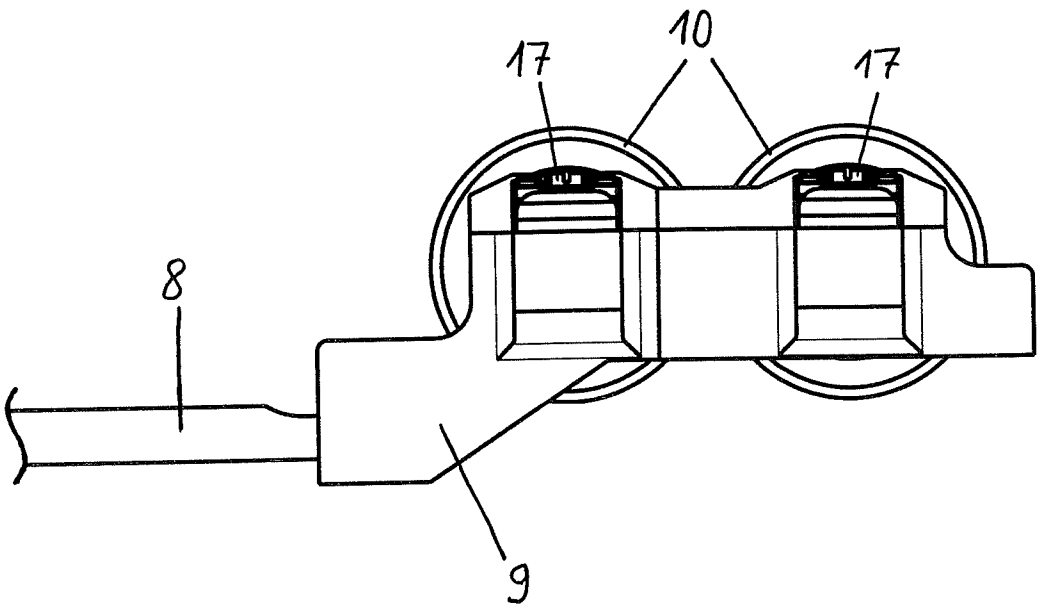
FIG. 10 shows a roller block with rolling elements of another device according to the invention with two rolling elements in a side view.

FIG. 10 shows an alternative embodiment with two rollers. This can be used, for example, if the tongue stroke is greater than the width of the foot of the switch rail plus the roll-up distance.

The invention claimed is:

1. A device for supporting a switch rail of a switch, the device comprising:

a projecting leaf spring configured and arranged to be pretensioned to the switch rail, and on which the switch rail is displaceably arranged; and a guide body configured and arranged to be fastened to a stock rail, the guide body including a slide attached to be adjustable along a longitudinal direction of the guide body and further attached to a first end of the projecting leaf spring, and a rolling element arranged on a second end of the projecting leaf spring opposite the slide.

2. The device of claim 1, wherein the projecting leaf spring is positioned partly within the guide body.

3. The device of claim 1, characterized in that the slide is fastened to the guide body via a frictional connection.

4. The device of claim 1, characterized in that the slide is fastened to the guide body via a connection, the connection including a surface, a surface structure, and a counter-surface of lesser hardness than the surface.

5. The device of claim 4, wherein the surface structure is flat, and the surface is configured and arranged to be impressed into the counter-surface in response to the fastening of the slide to the guide body.

6. The device of claim 4, wherein the surface structure is uneven, and the surface is configured and arranged to be impressed into the counter-surface in response to the fastening of the slide to the guide body.

7. The device of claim 1, characterized in that the slide is fastened to the guide body via a positive connection.

8. The device of claim 7, wherein the positive connection is a screw connection arranged on the side wall of the guide body.

9. The device of claim 1, further including a clamp body fastened by means of clamps to a foot of the stock rail.

10. The device of claim 9, characterized in that at least one of the clamps is connected to the clamp body at different positions.

11. The device of claim 9, characterized in that the clamp body is connected to the guide body in different positions.

12. The device of claim 1, characterized in that the guide body has a rectangular cross-section.

13. The device of claim 1, characterized in that a side of the leaf spring facing away from the stock rail has a distance (A) from a web part of the guide body facing the stock rail.

14. The device of claim 1, characterized in that the rolling element is configured and arranged to be fastened to the leaf spring so as to be height-adjustable via a roller block.

15. The device of claim 14, characterized in that the roller block is configured and arranged on the leaf spring so as to be pivotable about a vertical axis of the roller block.

16. The device of claim 14, wherein the rolling element is_one rolling element arranged on the roller block.

17. The device of claim 14, wherein the rolling element is two rolling elements.

18. The device of claim 17, wherein the two rolling elements are configured and arranged on the roller block with parallel axes.

19. The device of claim 14, wherein the rolling element is configured and arranged to be height-adjustable on the roller block via at least one screw.

* * * * *